US009163466B2

(12) United States Patent
Vavik

(10) Patent No.: US 9,163,466 B2
(45) Date of Patent: Oct. 20, 2015

(54) FLUID DIVERTER SYSTEM FOR A DRILLING FACILITY

(75) Inventor: Dag Vavik, Kristiansand (NO)

(73) Assignee: AKER MH AS, Kristiansand (NO)

( * ) Notice: Subject to any disclaimer, the term of this patent is extended or adjusted under 35 U.S.C. 154(b) by 0 days.

(21) Appl. No.: 14/129,452

(22) PCT Filed: Jun. 19, 2012

(86) PCT No.: PCT/EP2012/061711

§ 371 (c)(1),
(2), (4) Date: Feb. 7, 2014

(87) PCT Pub. No.: WO2013/000764

PCT Pub. Date: Jan. 3, 2013

(65) Prior Publication Data

US 2014/0166360 A1 Jun. 19, 2014

(30) Foreign Application Priority Data

Jun. 27, 2011 (NO) ..... 20110918

(51) Int. Cl.
*E21B 7/12* (2006.01)
*E21B 21/00* (2006.01)
(Continued)

(52) U.S. Cl.
CPC ..... *E21B 21/001* (2013.01); *E21B 7/12* (2013.01); *E21B 21/01* (2013.01); *E21B 21/067* (2013.01); *E21B 21/08* (2013.01)

(58) Field of Classification Search
CPC ..... E21B 7/12; E21B 21/001; E21B 21/01; E21B 21/067; E21B 21/08
USPC ..... 175/5, 66, 206, 207; 166/357, 358
See application file for complete search history.

(56) References Cited

U.S. PATENT DOCUMENTS 4,282,939 A * 8/1981 Maus et al. ..... 175/7
4,440,239 A * 4/1984 Evans ..... 175/5
(Continued)

FOREIGN PATENT DOCUMENTS

WO WO 2009/123476 A1 10/2009

OTHER PUBLICATIONS

Kozicz, John, "Development of a Marine Riser Gas Management System," Proceedings of IADC/SPE Asia Pacific Drilling Technology Conference and Exhibition, Jul. 9, 2012, vol. 156399, pp. 1-6.
(Continued)

*Primary Examiner* — Matthew Buck
(74) *Attorney, Agent, or Firm* — Birch, Stewart, Kolasch & Birch, LLP

(57) ABSTRACT

A fluid diverter system for a drilling facility comprises a diverter housing (15; 15') fluidly connected to a tubular (3, 42, 43) extending to a subsea well. The diverter housing (15; 15') comprising a movable diverter element (2) for closing off the diverter housing, a first fluid conduit (44) connected to a mud system and comprising a first valve (5), at least one second fluid conduit (20; 20') leading from an outlet (46; 46') in the diverter housing to an overboard location and comprising a second valve (1; 48), and a third fluid conduit (16) connected to a mud/gas separator (MGS) (13) and comprising a third valve (4). The MGS (13) is arranged below the outlet (50) of the diverter line, whereby riser fluids may be fed from the diverter housing (15) to the MGS (13) by means of gravity flow. The diverter valve (1; 48) on a leeward side of the drilling facility is configured to be open before the diverter element (2) closes around the tubular (3).

15 Claims, 4 Drawing Sheets

(51) Int. Cl.

| | |
|---|---|
| ***E21B 21/06*** | (2006.01) |
| ***E21B 21/08*** | (2006.01) |
| ***E21B 21/01*** | (2006.01) |

(56) References Cited

U.S. PATENT DOCUMENTS

| | | | | | |
|---|---|---|---|---|---|
| 4,444,250 | A | * | 4/1984 | Keithahn et al. | 166/84.4 |
| 4,502,534 | A | * | 3/1985 | Roche et al. | 166/84.4 |
| 4,546,828 | A | * | 10/1985 | Roche | 166/84.4 |
| 4,646,844 | A | * | 3/1987 | Roche et al. | 166/379 |
| 4,666,471 | A | * | 5/1987 | Cates | 95/262 |
| 4,709,900 | A | * | 12/1987 | Dyhr | 251/5 |
| 4,828,024 | A | * | 5/1989 | Roche | 166/84.4 |
| 4,832,126 | A | * | 5/1989 | Roche | 166/358 |
| 5,007,488 | A | * | 4/1991 | Donovan | 175/59 |
| 5,080,182 | A | * | 1/1992 | Thompson | 175/48 |
| 5,890,549 | A | * | 4/1999 | Sprehe | 175/71 |
| 5,975,219 | A | * | 11/1999 | Sprehe | 175/48 |
| 6,234,258 | B1 | * | 5/2001 | Karigan | 175/66 |
| 6,276,455 | B1 | * | 8/2001 | Gonzalez | 166/357 |
| 6,328,118 | B1 | * | 12/2001 | Karigan et al. | 175/66 |
| 7,243,741 | B2 | * | 7/2007 | Swartout | 175/209 |
| 7,575,073 | B2 | * | 8/2009 | Swartout | 175/209 |
| 8,033,335 | B2 | * | 10/2011 | Orbell et al. | 166/367 |
| 2005/0269135 | A1 | * | 12/2005 | Swartout | 175/66 |
| 2005/0269137 | A1 | * | 12/2005 | Swartout | 175/207 |
| 2006/0113110 | A1 | * | 6/2006 | Leuchtenberg | 175/38 |
| 2008/0060846 | A1 | * | 3/2008 | Belcher et al. | 175/25 |
| 2008/0190668 | A1 | * | 8/2008 | Swartout | 175/207 |
| 2011/0100710 | A1 | * | 5/2011 | Fossli | 175/7 |
| 2011/0114387 | A1 | * | 5/2011 | Belcher et al. | 175/57 |
| 2012/0227978 | A1 | * | 9/2012 | Fossli et al. | 166/363 |

OTHER PUBLICATIONS

Marsh, Gary L., "Final Fateful Flaws," Deepwater Horizon Study Group, Jan. 2011, pp. 1-5.

* cited by examiner

FLUID DIVERTER SYSTEM FOR A DRILLING FACILITY

FIELD OF THE INVENTION

The invention relates to the extraction of hydrocarbons from subsea, subterranean, wells. More specifically, the invention relates to a system for handling fluids from a wellbore, as specified in the preamble of the independent claim 1.

BACKGROUND OF THE INVENTION

Diverter systems for use in subsea drilling into hydrocarbon wells are well known. Originally, diverter systems were installed on drill ships or semi-submersible drilling rigs in order to handle shallow gas when drilling with a marine riser on top hole sections before the Blow-Out Preventer (BOP) was installed. Today it is more common to drill the top hole sections with seawater or water based mud and with return to seabed or "riserless" return to the rig.

Today, the main purpose of the diverter system is to handle gas that for some reason has entered the riser after the BOP is shut in on a so-called "kick". A kick is a situation where hydrocarbons, water, or other formation fluid enters the wellbore during drilling, because the pressure exerted by the column of drilling fluid is not great enough to overcome the pressure exerted by the fluids in the formation being drilled. As the industry is going to deeper water it has been more difficult for the drillers to detect a kick early because the gas will be in liquid or dense phase, due the static pressure at sea level (where the BOP is located). Hydrocarbons in liquid or dense phase are much less compressible than hydrocarbons in gas phase. A typical natural gas will go into dense phase if the pressure is above 153.5 bara (Cricondenbar) and temperature between −29° C. (Critical temperature) and +99° C. (Cricondentherm). As the gas (in liquid or dense phase) travels up the marine riser, the static pressure is reduced, and the gas goes from liquid/dense phase to gas/vapour phase and expands several hundred times.

When the gas is expanding in the riser it may fill the entire annulus, pushing the static column of mud back to the rig, even if the BOP is closed. As the static mud column is reduced and the gas travels up the riser, the mud will come back at an accelerating and increasing flow rate. When the diverter system is activated, this mud and gas will be diverted safely overboard.

On many rigs, a so-called "mud/gas separator" (MGS) has been utilized in the diverter system in an attempt to separate the mud from the gas and return the mud to the system, thus avoiding mud discharge to the sea. Publication "API RP 64, RECOMMENDED PRACTICE FOR DIVERTER SYSTEMS EQUIPMENT AND OPERATIONS", issued by the American Institute of Technology (API) states in section 7.2.4, entitled "Inadvertent Gas Entry into the Riser", that:

> "Shallow gas flows are not the only application for a diverter system when using a marine riser. Gas may inadvertently enter the riser while drilling at any depth when the BOP is shut-in on a kick. Gas may also enter the riser if the rams leak after the BOP is closed. Gas in the riser may be safely removed by diverting the flow overboard. In some designs, a mud/gas separator is utilized in the diverter system to separate the gas from the mud and return the mud to the system. Again, the design should not allow the diverter to completely shut-in the well."

The way this is solved in the prior art is that the diverter element, the return flow line and the diverter lines have been closed at the same time, forcing the fluid returning from the riser to go up to the MGS located at a higher level. This is illustrated in FIG. 1, which is a disclosure on page 114 in the BP public report entitled "Deepwater Horizon Accident Investigation Report" (published Sep. 8, 2010).

The dangerous parts of this design is that the flow rate of mud returning from the riser is much higher than the design capacity of the MGS, resulting in filling of MGS and vent line. On most of the rigs with this system it is up to the driller (operating procedures) to open the diverter overboard valve if he believes that the returns flow exceeds the capacity of the MGS.

In some rigs, an extra high level trip in the MGS and/or high pressure trip in the diverter housing has been installed to automatically open the diverter overboard line on high level in MGS or high pressure in the diverter housing.

In either one of these designs, the dangerous part is that the available time in which to take the appropriate action, i.e. before the vent line of the MGS is completely filled, is very limited. At the time when high level in the MGS or high pressure in the diverter have been reached, the mud returning from the riser is in a highly accelerating mode and the time available for opening the diverter valve is very limited.

A slug of heavy mud accelerating up the MGS vent line followed by a two phase flow and finally a large gas release will create an increased pressure in the diverter housing and possible leakage in the slip joint resulting in gas being release under the rig at the slip joint connection. A worst case scenario of such an event is the Deepwater Horizon disaster.

The present inventor has devised and embodied the invention to overcome the shortcomings of the prior art and to obtain further advantages.

SUMMARY OF THE INVENTION

The invention is set forth and characterized in the main claim, while the dependent claims describe other characteristics of the invention.

It is thus provided a fluid diverter system for a drilling facility, comprising a diverter housing fluidly connected to a tubular extending to a subsea well; the diverter housing comprising a movable diverter element for closing off the diverter housing, a first fluid conduit connected to a mud system and comprising a first valve, at least one second fluid conduit leading from an outlet in the diverter housing to an outlet at an overboard location and comprising a second valve, and a third fluid conduit connected to a mud/gas separator (MGS) and comprising a third valve, characterized in that the MGS is arranged below the outlet of the diverter line, whereby riser fluids may be fed from the diverter housing to the MGS by means of gravity flow.

In one embodiment, an inlet into the MGS from the third fluid conduit is arranged a vertical distance below the outlet from the diverter housing.

The MGS is preferably fluidly connected to mud treatment facilities via a liquid seal.

In one embodiment, the MGS further comprises a first pressure transmitter, and the liquid seal comprises second and third pressure transmitters, arranged a vertical distance apart, and a monitoring and control system, whereby the liquid seal density may be determined.

In one embodiment, the third valve is interlocked with a level indicator for the liquid seal.

In one embodiment, the second fluid conduit slopes upwards such that its outlet is at a higher elevation that its inlet.

In one embodiment, the diverter valve on a leeward side of the drilling facility is configured to be open before the diverter element closes around the tubular.

The invention allows an MGS to receive riser fluid in a safer way than with the known systems.

With the invented system, riser fluids are routed to the MGS by means of gravity flow, allowing the diverter valve to the leeward side being open and diverter element closed at the same time. This is solved by installing a MGS at a lower level than the divert line outlets. The gas is vented safely overboard while the drilling fluid is returned to the mud system. In a practical application, this MGS may be a second MGS and especially designated for taking the fluids from the marine riser.

It is thus provided that any gas that may have entered the riser after the BOP is shut-in on a kick is vented safely overboard and at the same time mud can be returned to the system in a safe way.

It also provide that "Drilled gas" can be routed safely to the MGS separator from the diverter keeping the diverter element closed preventing gas breaking out through the diverter housing and escaping on drill floor. When running the system in degasser mode, it will allow the gas cut mud to go through a two stage separating process. The MGS will take out the gas that normally would escape to drill floor and the shakers, while the second stage is done by the degassers in the mud treatment tanks. Degassers are used to separate entrained gas bubbles in the drilling fluid which are too small to be removed by the MGS.

BRIEF DESCRIPTION OF THE DRAWINGS

These and other characteristics of the invention will be clear from the following description of a preferential form of embodiment, given as a non-restrictive example, with reference to the attached drawings wherein.

DETAILED DESCRIPTION OF A PREFERENTIAL EMBODIMENT

Figure 1:
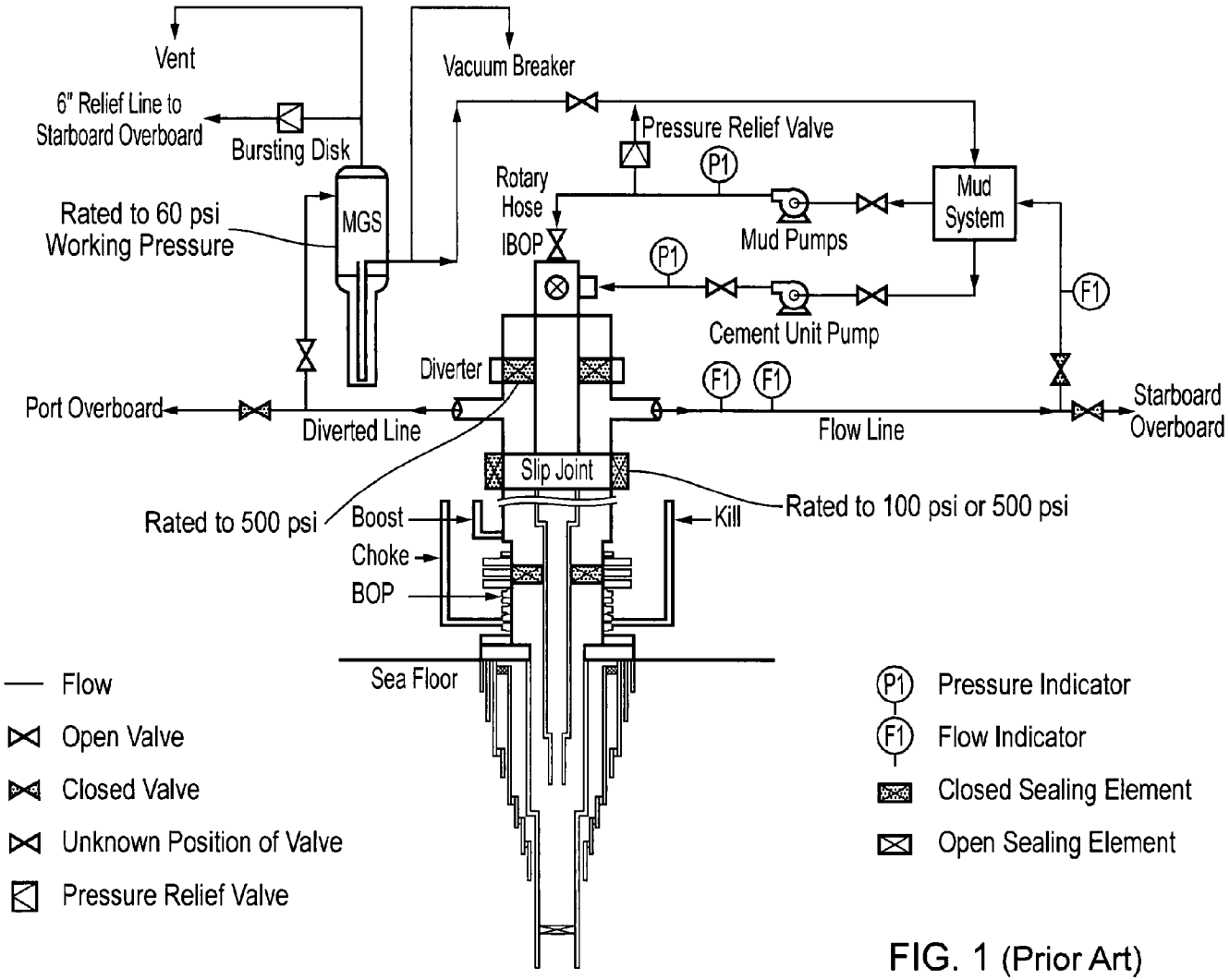
FIG. 1 (Prior Art)
FIG. 1 is a simplified schematic representation of the BOP rams, diverter element and valves position according to the prior art, also representing a typical arrangement on drill ships or semi-submersible drilling rigs. The figure is copied from page 114 of the BP public report entitled "Deepwater Horizon Accident Investigation Report" (published Sep. 8, 2010)

A drill string 3 extends between a topsides drill floor (not shown) and a seabed BOP (not shown), extending in a telescopic so-called "slip-joint" 42 and a marine riser 47 thus defining an annulus 43. This arrangement is well known in the art, and need therefore not be described further.

A diverter housing 15 is arranged in fluid communication with the annulus 43 and a diverter line 20 which extends from an outlet 46 in the diverter housing and to an outlet 50 at an overboard location. A diverter housing normally has two diverter lines, extending to the port and starboard sides, respectively, of the vessel, such that the diverter line on the leeward side may be used, as explained above. For illustration purposes, however, only one diverter line is shown. A diverter valve 1 is arranged in each diverter line 20. In the figures, the diverter valve 1 is shown in an open state (white typeface).

The diverter housing 15 is also connected to the vessel's mud system (not shown) via a flow line 44, the flow in which is controlled by a flow line valve 5. In the figures, the flow line valve 5 is shown in a closed state (grey typeface). A diverter element 2 is arranged to close around the drill string 3, and is in figures shown in a closed state. Reference number 14 indicated the fluid level in the diverter housing 15.

The diverter housing 15 is fluidly connected to an MGS 13 via an MGS line 16. The flow in the MGS line 16 is controlled by an MGS valve 4, which in the figures is shown in an open state (white typeface). A vent line 21 extends from the MGS. Normally, this vent line 21 extends to a distance (typically 4 meters) above the top of the derrick (not shown).

The MGS is furthermore fluidly connected to the shakers 24 via an outlet line 45, and the shaker 24 feeds into a sand trap 18 and a degasser 19, in a known fashion. The outlet line 45 effectively forms a liquid seal 6 by running a downward distance $h_1$ before it loops back up to a level A which is higher than the connection point of the outlet line to the MGS 13. At the bottom of the outlet line 45 loop, an inspection and draining device 22 is arranged (only schematically illustrated), by means of which any blockage or cuttings may be monitored and removed from the line.

Figure 2:
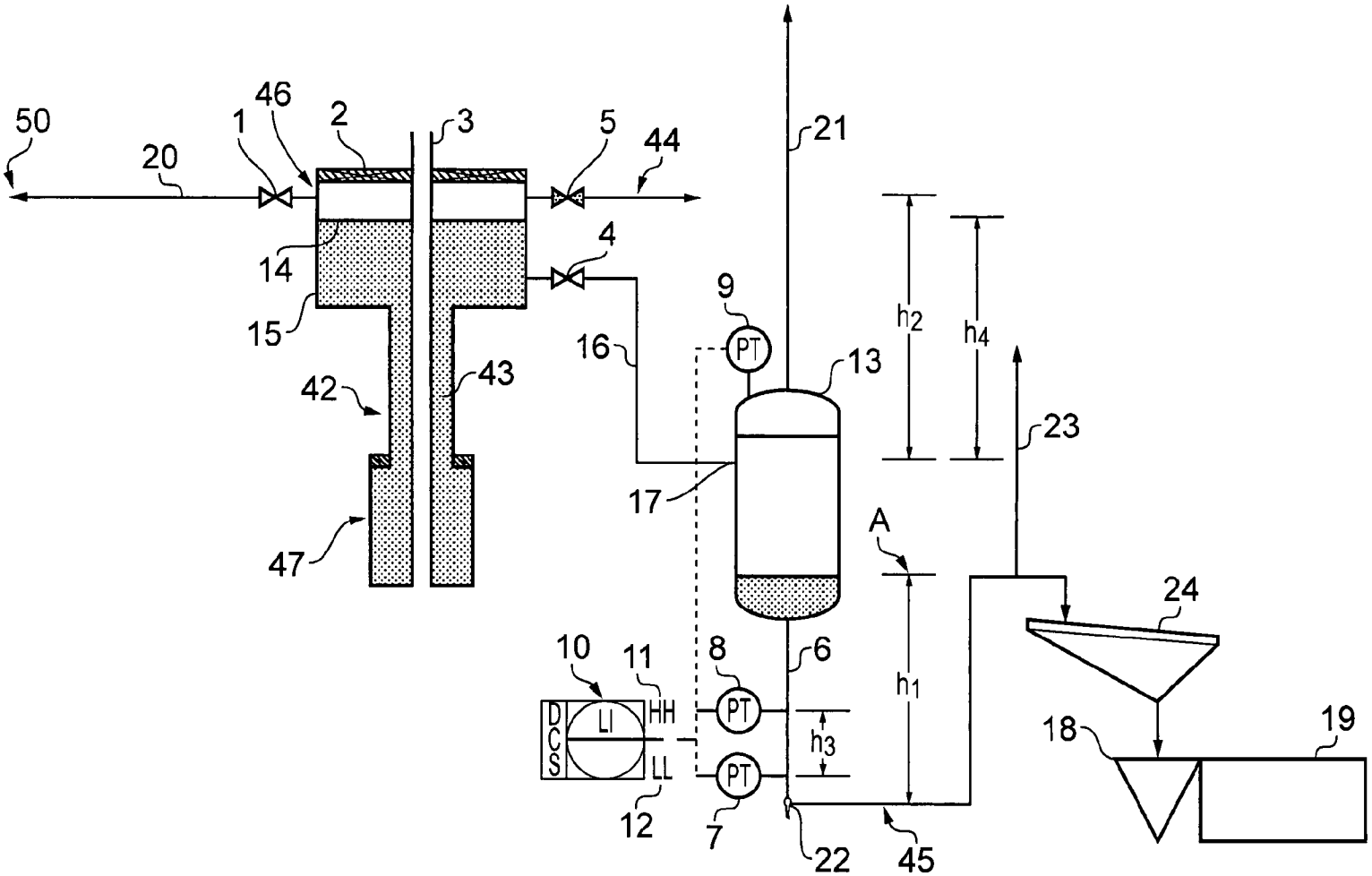
FIG. 2 is a simplified schematic representation of the invented system.

The MGS 13 is arranged at level which is lower than the diverter housing, such that riser fluids flow in the MGS line 16 by the influence of gravity. More specifically, the MGS line inlet 17 is at a lower level than the diverter line 20 outlet from the diverter housing, and the outlet 50 of the diverter line, and the liquid level in the diverter housing. In FIG. 2, these height differences are indicated by the reference letters $h_2$ and $h_4$, respectively. With this arrangement, any gas that may have entered the riser after the BOP has been shut-in on a kick, is vented safely overboard and at the same time mud can be returned to the system in a safe way.

Figure 3:
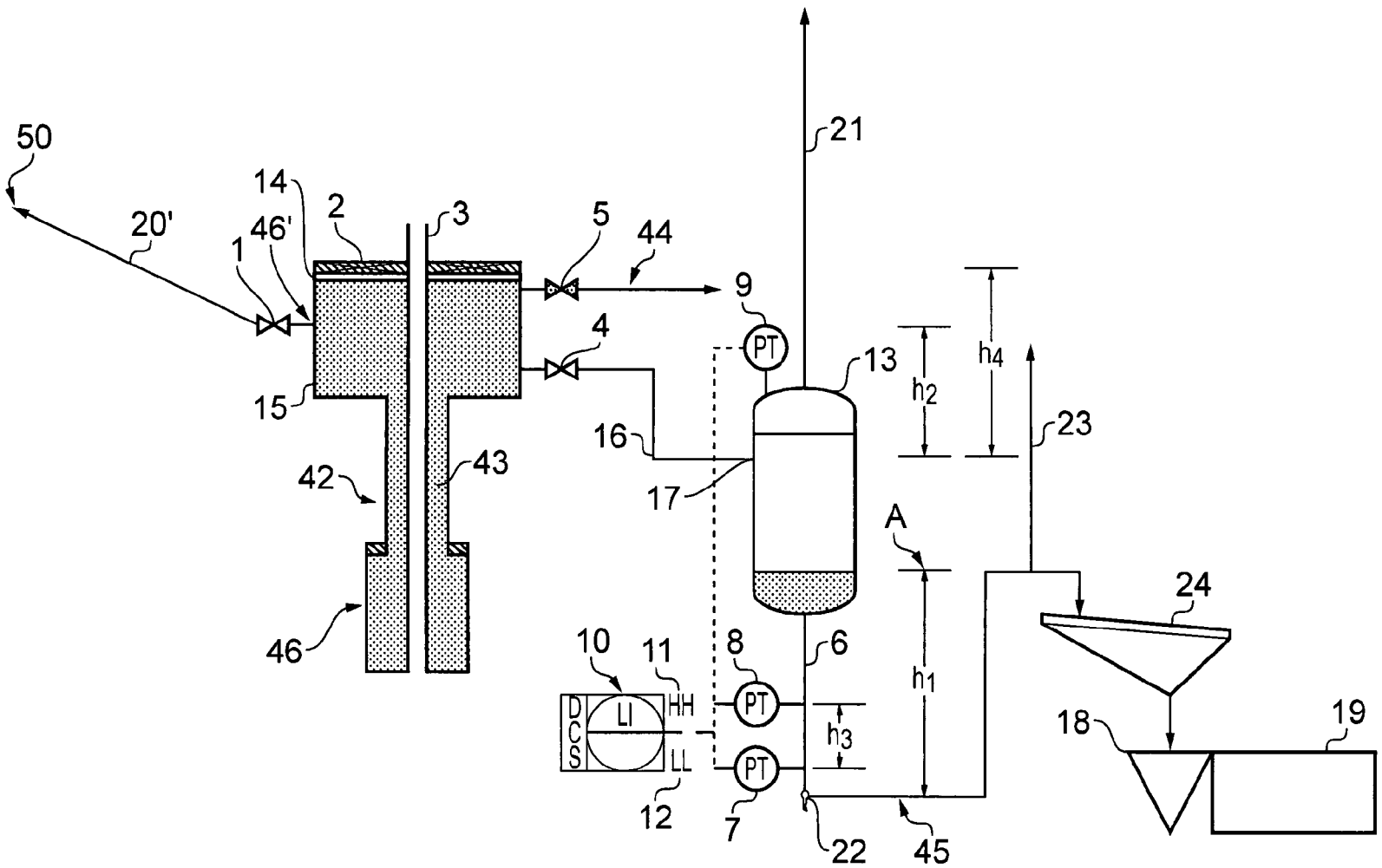
FIG. 3 is a simplified schematic representation of an alternative embodiment of the invented system.

FIG. 3 shows an alternative embodiment, in which the diverter line(s) 20' is (are) sloping upwards to an outlet 50 and thus may be partly filled with liquid, since the outlet to the MGS line 16 is at the same or at a higher level than the outlet(s) to the diverter line(s) 20'. If the outlet to the MGS line 16 is kept at a higher level than the outlet(s) 46' to the diverter line(s) 20', a liquid seal will form in the diverter line reducing the amount of gas being vented in the diverter line when the system is run in "Degasser mode". This alternative provides a more compact arrangement and will thus require less height between the drill floor level and the shaker deck, compared to the embodiment shown in FIG. 2. The diverter line 20' preferably comprises heat tracing (not shown) or similar heating means to prevent rain water from freezing and hence blocking the diverter line.

Figure 4:
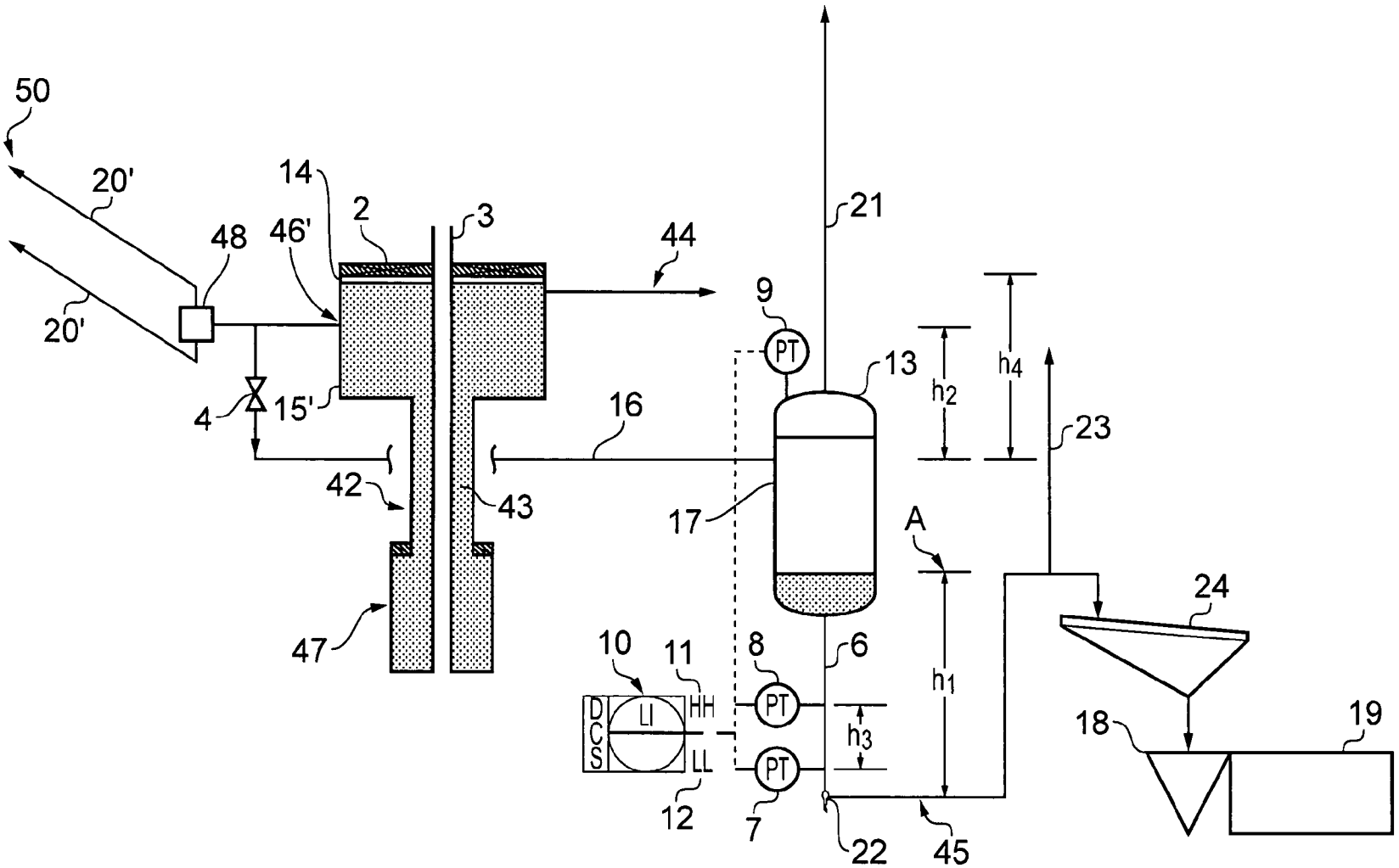
FIG. 4 is a simplified schematic representation of an alternative embodiment of the invented system, used in a Hydril® Marine Riser Diverter system.

FIG. 4 shows yet an alternative embodiment, where the invented system is used in a Hydril® Marine Riser Diverter system 15', which is known per se. In this alternative there are no external diverter valves, but only a flow selector 48 routing the diverted flow to the leeward diverter line 20'. The outlet to the MGS line 16 is taken from the diverter line before the flow selector, and the diverter lines 20' are sloping upwards to the outlet as in FIG. 3. The flow selector 48 may be of a known type, e.g. such as the Hydril® Pressure Control Flow Selector.

A vacuum breaker line 23 is fluidly connected to the outlet line 45, in order to avoid siphon effects emptying the outlet line 45.

A first pressure transmitter 9 is arranged in the upper region of the MGS 13, and second and third pressure transmitters 7, 8 are arranged in the lower region of the liquid seal 6. The second 7 and third 8 pressure transmitters are arranged with a vertical spacing $h_3$, thus facilitating the calculation of the liquid seal density. A liquid level indicator 10 receives signals (dotted lines) from the pressure transmitters 7, 8, 9 and is also connected to a driller's control system DCS.

The diverter valve 1, diverter element 2, MGS valve 4 and flow line valve 5 are all interconnected (control and activation lines not shown) via the DCS/BOP control system. Such control systems are well known, and need therefore not be described further.

Reference number 11 indicates a high level reading HH in the MGS 13, and reference number 12 indicates a low level reading LL in the liquid seal 6.

The invented system is are useful in the following modes: a) Diverter mode, b) Degasser mode, and c) Trip gas mode.

a) Diverter Mode

If gas inadvertently has entered into the marine riser due to late BOP shut-in on a kick or if the rams leak after the BOP is closed, the gas in the riser will continue to rise to the surface and must be safely diverted overboard.

The Deepwater Horizon disaster is an ultimate example of this operational mode, and what potential disaster that can happen if this is not routed safely overboard. BP's publication, "Deepwater Horizon Accident Investigation Report", (published Sep. 8, 2010), indicates that hydrocarbons entered the riser at approximately 21:38 hours (page 98) and the first BOP ram was shut-in at approximately 21:41. I.e. the BOP was actuated at approximately 3 minutes too late to stop hydrocarbons entering into the riser. The report also shows that the first ram did not seal 100% and a second ram was activated at approximately 21:46 (Table 2, page 103). At approximately 21:47 the BOP was 100% sealed. The first explosion occurring at 21:49:20 was entirely caused by the gas that had already entered the riser. The investigation report also concludes that routing the mud and gas back to the MGS keeping both the diverter valves and the diverter element closed at the same time was one of the direct cause of the explosion.

A significant feature of the invention is that the diverter valves are interlocked with the diverter valve and diverter element such that the diverter valve 1 which is being used (i.e. on the leeward side) is open before the diverter element 2 closes around the drill string 3. At the same time, mud may be allowed to return safely to the MGS 13 by gravity through MGS valve 4 and line 16.

By interlocking the diverter valves (i.e. diverter valve 1 on leeward side is open before the diverter element 2 closes around the drill string 3), the invented system complies with the "ABS GUIDE FOR THE CLASSIFICATION OF DRILLING SYSTEMS 2011", which in section 3.7.3 (Control Systems for Diverters) states:

"iv) The control systems are to have interlocks so that the diverter valve opens before the annular element closes around the drill string."

The invented system also complies with "DNV-OS-E101 DRILLING PLANT, October 2009", which in chapter 2, section 5 (303 Control and monitoring, item 0.2.) states:

"The diverter control system shall be equipped with an interlock to ensure that the valve in the diverter pipe which leads out to the leeward side is opened before the diverter closes around the drilling equipment."

Normal well control response when the BOP is shut-in on a kick is to take a flow check through the flow line 44 and flow line valve 5. In this initial stage, the diverter element 2 will normally be open and the diverter valve 1 and MGS valve 4 closed. If flow check shows that the well is still gaining, action to close a second ram is normally taken immediately. If drilling fluids are still coming back, preparation for "riser blow-out" is to be taken.

With the invention, a first step to prepare for a "riser blow-out" is to check that the liquid seal 6 in the MGS is filled up. Mud filling means (not shown) for filling the liquid seal 6 is provided. The liquid seal 6 is fitted with the two pressure transmitters 7, 8 described above, located near the bottom of the liquid seal 6 and at a vertical distance $h_3$ apart in order to calculate fluid density in the seal. A suitable value for $h_3$ is 0.5 meter. The liquid seal integrity is to be corrected against the reading from the first pressure transmitter 9, by the control system DCS in order to get a true reading of the liquid seal integrity (i.e. level indication), provided by the level indicator 10 also when gases are being vented out.

As an extra level of safety the MGS valve 4 will close on high level 11 in the MGS 13 or low level 12 in the liquid seal 6.

When a confirmed level in the liquid seal 6 has been established, the MGS valve 4 can be opened and the level in the diverter housing 14 be drained down to a level below the outlet to the diverter valve 1 and the outlet to the flow line valve 5. Confirmation that the level 14 has been drained down is obtained by observing the flow in flow line 44 going down to zero. As an option, a level transmitter (not shown) can be mounted in the diverter housing 15 in addition.

The MGS line 16 from the diverter housing 15 to the MGS 13 is preferably sized for maximum 80% of total degasser capacity, in order not to exceed the capacity of the MGS and the downstream sand trap 18. The degasser (not shown) in the degasser tank 19 can either be of centrifugal or vacuum type. A large capacity MGS line 16 will not avoid drilling fluid being disposed to sea in the event of a "riser blow-out"; it will only reduce the amount being disposed to sea in a safe manner avoiding gas breaking out of the drilling fluid being disposed to drill floor, but safely being vented overboard.

Sizing criteria for the MGS line 16 will typically be in the order of maximum 1000 to 1500 gpm. The MGS line 16 is preferably sized for pipe running liquid full and the driving force will be the total available static pressure head between the level 14 in the diverter housing 15 and the inlet elevation of the MGS inlet 17, shown as $h_4$ in FIG. 2 and FIG. 3. To reduce the entrance pressure loss, the outlet of the diverter housing 15 and the MGS valve 4 should have the next larger pipe diameter compared to pipe diameter for the MGS line 16, for the first ten pipe diameter lengths (for example, if the pipe diameter is 0.25 meter (DN250), then this diameter is to be used in the first 2.5 meters before reducing pipe diameter to 0.2 meter (DN200)). Likewise, consideration should be taken to reduce the pipe diameter or install an orifice at the MGS inlet 17, in order to ensure that the MGS line 16 is running full of liquid. The total capacity of the MGS line 16 will depend of the line size and the total available static pressure head, depending on the layout. Typical values for $h_4$, i.e. difference in elevation between the level 14 in the diverter housing and the elevation of the MGS inlet 17, are between 2 and 5 meters.

In the event of a "riser blow-out", the capacity of the MGS line 16 will be exceeded and the excess riser fluid is being disposed safely to sea through the diverter lines 20. The capacity of the MGS 13 will, however, not be exceeded, since the outlet to the liquid seal 6 typically as a minimum has the next larger pipe diameter compared to pipe diameter for the MGS inlet 17. Also, when the level in the MGS 13 increases due to increased pressure in the diverter housing 15, it will not fill the MGS vent line 21 since the pressure in the diverter housing 15 is limited to the backpressure caused by the riser fluid flowing through the diverter line 20 and MGS line 16. In case of blocked liquid seal outlet 6 from the MGS 13 (i.e. blockage in outlet line 45), the MGS 13 will overfill but the MGS vent line 21 will not, since the diverter valve 1 is open. In this case the MGS valve 4 will close as an extra level of safety on HH level 11 and to prevent further riser fluids being diverted to the blocked MGS 13.

The height $h_1$ of the liquid seal 6 should be sized to prevent gas blow-by to the treatment tanks. A minimum liquid seal of $h_1$=6 meters (20 ft) is recommended for drill ships or semi-submersible drilling rigs operating on deep water. If not otherwise specified from the authorities (ABS, DNV, etc.), the maximum blow-by case to be considered should be based on the peak gas flow rate from the Deepwater Horizon accident of 165 mmscfd (approx. 200 000Sm3/h) (c.f. FIG. 1 on page 113 in BP public report "Deepwater Horizon Accident Investigation Report", (published Sep. 8, 2010)). The gas peak flow rate will be vented proportionally between the diverter line 20 and the MGS vent line 21 via the MGS line 16. Line size of diverter line 20 and MGS vent line 21 to be set to keep backpressure in MGS 13 below an acceptable level to prevent gas blow-by to the shakers 24.

Although diverter line 20 and the MGS vent line 21 are sized to prevent gas blow-by to the treatment tanks, an extra level of safety is built in to automatically close the MGS valve 4 on LL level 12 if the integrity of the liquid seal 6 are lost for some reason.

To prevent the liquid seal 6 from being emptied by a siphon effect, the liquid seal top to be fitted with a vacuum breaker 21 as described above.

Under normal well control scenarios, it will take time for the gas that may have entered the marine riser to reach the surface, especially in deep waters. The drilling fluid coming back will be at a low rate in the beginning and exponentially increase in flow rate as the gas are getting closer to the surface. Thus there should be time to prepare for a "riser blow-out" as described above. However, at any time, if there is a rapid expansion of gas in the riser, the diverter element 2 must be closed (if not already closed) and the flow diverted overboard. The automatic diverter interlock system ("panic button") will ensure that the diverter valve 1 to the leeward side opens before the diverter element 2 closes. This system will work according to the regulations regardless of the position of the MGS valve 4.

b) Degasser Mode

Although the invented system will collect drilling fluid in a safe manner and reduce the environmental impact in case of a "riser blow-out", the real benefit is obtained when the system is used for circulating out "Drilled gas" in a two stage degassing process.

A certain amount of the gas in cuttings will enter into drilling fluid when drilling through porous formations that contain gas. The gas showing on the surface due to drilling through formations is called "Drilled Gas". Even though the hydrostatic pressure exerted by the mud column is greater then the formation pressure, gas showing on the surface by this mechanism always happens. It is not practicable to increase mud weight sufficiently to make it disappear.

If the formation being drilled contains a lot of drilled gas under high pressure, and this gas will expand as it travels up the riser and gas may break out of the drilling fluid in the diverter housing 15 and also reduce the density of the gas cut mud in the riser. If the gas concentration in the gas cut mud gets too high, the drilling should stop and gas cut mud should be circulated at a reduced rate through the MGS valve 4 and via the MGS 13 to the degasser tank 19, in a two stage separating process. In this way the entire mud volume in the annulus 43 including the marine riser can be degassed until it reaches an acceptable level prior to drilling ahead.

If gas is breaking out in the diverter housing 15 and leaks out to drill floor, the diverter element 2 can be closed after the level 14 in the diverter 15 has been drained down through the MGS valve 4, and the diverter valve 1 has been opened. In this way the gas from the gas cut mud can safely be vented overboard away from drill floor and the rig. The important embodiment of the invention is this degassing of the gas cut mud can be run in a two stage separating process without pressurising the diverter housing 15 and to jeopardise getting in conflict with the ABS GUIDE FOR THE CLASSIFICATION OF DRILLING SYSTEMS—2011 and DNV standard DNV-OS-E101.

c) Trip Gas Mode

Trip gas is caused by swabbing effect while tripping out of the hole. Gas will be seen at the surface while circulating "bottom up" after tripping back in the hole again. The invention can be used for circulating out trip gas by opening the MGS valve 4 and diverter valve 1 have been opened allowing the diverter element 2 to be closed. However, if we have a lot of trip gas the gas may go over to slug flow as it expands travelling up the riser, and may end up filling the entire riser annulus pushing a slug of mud out to the sea, if the capacity of the MGS line 16 is exceeded. A better way to eliminate possible pollution of the sea with mud is to circulate "bottom up" through the riser until the bottom are getting close to the BOP at the seabed and circulate the rest through the kill & choke lines in a normal way.

Embodiments of the invention have now been described with reference to the drawings, which are schematic and only show components which are necessary for elucidating the invention. Although the invention has been described with reference to specific embodiment, numerical values and modes of operation, it should be understood that the invention shall not necessarily be limited to such embodiments, values and modes.

The invention claimed is:

1. A fluid diverter system for a drilling facility, comprising a diverter housing located above a slip-joint connected to an upper end of a riser and fluidly connected to the riser extending to a subsea well; the diverter housing comprising a movable diverter element for closing off the diverter housing, a first fluid conduit connected to a mud system and comprising a first valve, at least one second fluid conduit leading from an outlet in the diverter housing to an outlet at an overboard location and comprising a second valve, and a third fluid conduit from an outlet above the slip-joint connected to a mud/gas separator (MGS) and comprising a third valve, and the MGS is arranged below the outlet of the second fluid conduit, wherein riser fluids are fed from the diverter housing to the MGS by means of gravity flow.

2. The fluid diverter system according to claim 1, wherein the second valve on a first side of the drilling facility is configured to be open before the diverter element closes around a drill string.

3. The fluid diverter system of claim 1, wherein a first side of the drilling facility is the leeward side.

4. The fluid diverter system of claim 1, wherein an inlet into the MGS from the third fluid conduit is arranged a vertical distance below the outlet from the diverter housing.

5. The fluid diverter system of claim 1, wherein the MGS is fluidly connected to mud treatment facilities via a liquid seal.

6. The fluid diverter system of claim 5, wherein the MGS further comprises a first pressure transmitter, and the liquid seal comprises second and third pressure transmitters, arranged a vertical distance apart, and a monitoring and control system, whereby the liquid seal density is determined.

7. The fluid system of claim 5, wherein the third valve is interlocked with a level indicator for the liquid seal.

8. The fluid system of claim 1, wherein the second fluid conduit slopes upwards such that its outlet is at a higher elevation than its inlet.

9. The fluid diverter system of claim 3, wherein an inlet into the MGS from the third fluid conduit is arranged a vertical distance below the outlet from the diverter housing.

10. The fluid diverter system of claim 3, wherein the MGS is fluidly connected to mud treatment facilities via a liquid seal.

11. The fluid diverter system of claim 4, wherein the MGS is fluidly connected to mud treatment facilities via a liquid seal.

12. The fluid system of claim 10, wherein the third valve is interlocked with a level indicator for the liquid seal.

13. The fluid system of claim 11, wherein the third valve is interlocked with a level indicator for the liquid seal.

14. The fluid system of claim 5, wherein the third valve is interlocked with a level indicator for the liquid seal.

15. The fluid system of claim 6, wherein the third valve is interlocked with a level indicator for the liquid seal.

* * * * *